US007666042B2

(12) United States Patent
Kermis

(10) Patent No.: US 7,666,042 B2
(45) Date of Patent: Feb. 23, 2010

(54) NO DRILL MULTIPORT DRIVE SHOWER

(76) Inventor: Paul Charles Kermis, 137 Pacer Dr., Henrietta, NY (US) 14467

( * ) Notice: Subject to any disclaimer, the term of this patent is extended or adjusted under 35 U.S.C. 154(b) by 9 days.

(21) Appl. No.: 12/028,030

(22) Filed: Feb. 8, 2008

(65) Prior Publication Data

US 2009/0203273 A1 Aug. 13, 2009

(51) Int. Cl.
*F01P 3/20* (2006.01)

(52) U.S. Cl. ..... 440/88 C; 248/205.1

(58) Field of Classification Search ..... 440/46, 440/88 C, 88 M, 88 R, 76, 89 R; 248/205.1
See application file for complete search history.

(56) References Cited

U.S. PATENT DOCUMENTS 2,766,714 A * 10/1956 Hammers ..... 440/89 R
4,371,351 A * 2/1983 Tousey ..... 440/88 M
5,304,079 A * 4/1994 Karls ..... 440/88 R
5,601,300 A * 2/1997 Fink et al. ..... 280/166
6,241,566 B1 6/2001 Kermis et al.
6,808,432 B1 10/2004 Davis et al.

OTHER PUBLICATIONS 4 pages from website of Rex Marine—http://shopping.rexmar.com dated Apr. 24, 2008 showing the It's Cool (TM) Drive Shower from Rex Marine.
3 pages from website of Just Wicked Marine—www.justwickedmarine.com/shower.htm dated Apr. 30, 2008 showing the Just Wicked Marine Drive Shower.

* cited by examiner

*Primary Examiner*—Lars A Olson
(74) *Attorney, Agent, or Firm*—Robert D. Gunderman, Jr.; Patent Technologies, LLC

(57) ABSTRACT

A cooling apparatus for a marine propulsion system outdrive unit that can be attached to an outdrive unit without the need to drill holes in any portion of the outdrive unit. The cooling apparatus has a distribution tube assembly with at least one pickup port and a water delivery feature such as dump ports, the pickup port being open to receive cooling water into the distribution tube assembly when mounted on a marine propulsion system outdrive unit and the water delivery feature positioned to face the drive unit for delivering cooling water from the distribution tube assembly to the outdrive unit. A no drill bracket attached to the distribution tube assembly attaches to the lift ram assembly shaft of the outdrive unit, and an upper mounting bracket that is attached to the distribution tube assembly attaches to the outdrive unit.

19 Claims, 8 Drawing Sheets

NO DRILL MULTIPORT DRIVE SHOWER

BACKGROUND OF THE INVENTION

1. Field of the Invention

This invention relates generally to cooling apparatus for marine propulsion system outdrive units, and more particularly to an improved multiport drive shower that does not require creating holes in the outdrive of the marine propulsion system.

2. Description of Related Art

Over the years there have been various attempts to cool marine propulsion systems. Cooling of marine propulsion systems is required to maintain proper operating temperatures of both the prime mover, such as an internal combustion engine, as well as the various power transfer systems used in marine propulsion systems, such as, for example, outdrives.

As the complexity of marine stern drive technology has developed, so has the need to keep the outdrive cool in a wider variety of operating conditions. U.S. Pat. No. 4,371,351 to Tousey describes a stern drive cooler that uses a conduit to carry water from below the water level of the vessel to a position over the stern drive. Such early cooling systems were able to direct cooling water only to the top of the stern drive, and were not capable of cooling the entire upper portion of the stern drive. In a stem drive, internal components such as gears, clutches and bearings produce heat. Under extreme operating conditions such as high RPMs, high torque levels, prolonged usage, and the like, the produced heat may become excessive. The detrimental effects to the outdrive can range from purely cosmetic to catastrophic failure if the heat begins to breakdown the drive oil used to lubricate the internal components of the stern drive. Although stern drive manufacturers have developed proprietary drive unit oils to help combat this heat induced breakdown, they have not been entirely successful in mitigating all of the effects of excessive heat in the outdrive.

Another example of an attempt to cool an outdrive of a stern drive device is U.S. Pat. No. 6,808,432 to Davis et al, and Assigned to Brunswick Corporation of Lake Forest, Ill. The entire disclosure of which is incorporated herein by reference.

The need to cool more than just the top of the outdrive led to the development of a multiport drive shower by Paul Kermis, as described in U.S. Pat. No. 6,241,566, the entire disclosure of which is incorporated herein by reference. While the multiport drive shower disclosed by Kermis in the '566 patent provided exceptional cooling ability, it continued to share one drawback common to all existing outdrive cooling devices. The technique used to mount the multiport drive shower to a stem drive involved creating holes through the anti-cavitation plate of the stern drive. This mounting technique is viewed by many to be too intrusive both cosmetically and structurally to the stern drive. In addition, the manufacturer has recently declared that piercing the protective coating on their current models of outdrives will void their corrosion warranty, thus voiding the manufacturer's warranty in many cases.

It is therefore an object of the present invention to provide a multiport drive shower that attaches to an outdrive without the need for creating holes in the outdrive, yet provide sufficient support to maintain the location and integrity of the pick-up port system. It is another object of the present invention to provide a multiport drive shower that efficiently takes water in using a ram effect through the use of softer and more elongated bends. It is another object of the present invention to provide a multiport drive shower that efficiently takes in water using a ram effect and delivers high volumes of cooling water to the outdrive. It is a further object of the present invention to provide a multiport drive shower that does not clog when encountering water-born debris. It is yet another object of the present invention to provide a multiport drive shower that effectively cools a multitude of heat producing locations along an outdrive.

BRIEF SUMMARY OF THE INVENTION

In accordance with the present invention, there is provided a cooling apparatus for a marine propulsion system outdrive unit having a lift ram assembly shaft, the cooling apparatus comprising a distribution tube assembly having at least one pickup port and a water delivery feature such as a plurality of dump ports, the pickup port being open to receive cooling water into the distribution tube assembly when mounted on a marine propulsion system outdrive unit and the water delivery feature being positioned to face the drive unit for delivering cooling water from the distribution tube assembly to the outdrive unit, at least one no drill bracket mechanically attached to said distribution tube assembly for mounting the cooling apparatus to the lift ram assembly shaft of said outdrive unit, and an upper mounting bracket mechanically attached to said distribution tube assembly for mounting the cooling apparatus to said outdrive unit. The cooling apparatus for a marine propulsion system outdrive unit described herein is also referred to as a multiport drive shower or a no drill multiport drive shower.

The foregoing paragraph has been provided by way of introduction, and is not intended to limit the scope of the following claims.

BRIEF DESCRIPTION OF THE DRAWINGS

The invention will be described by reference to the following drawings, in which like numerals refer to like elements, and in which.

Figure 1:
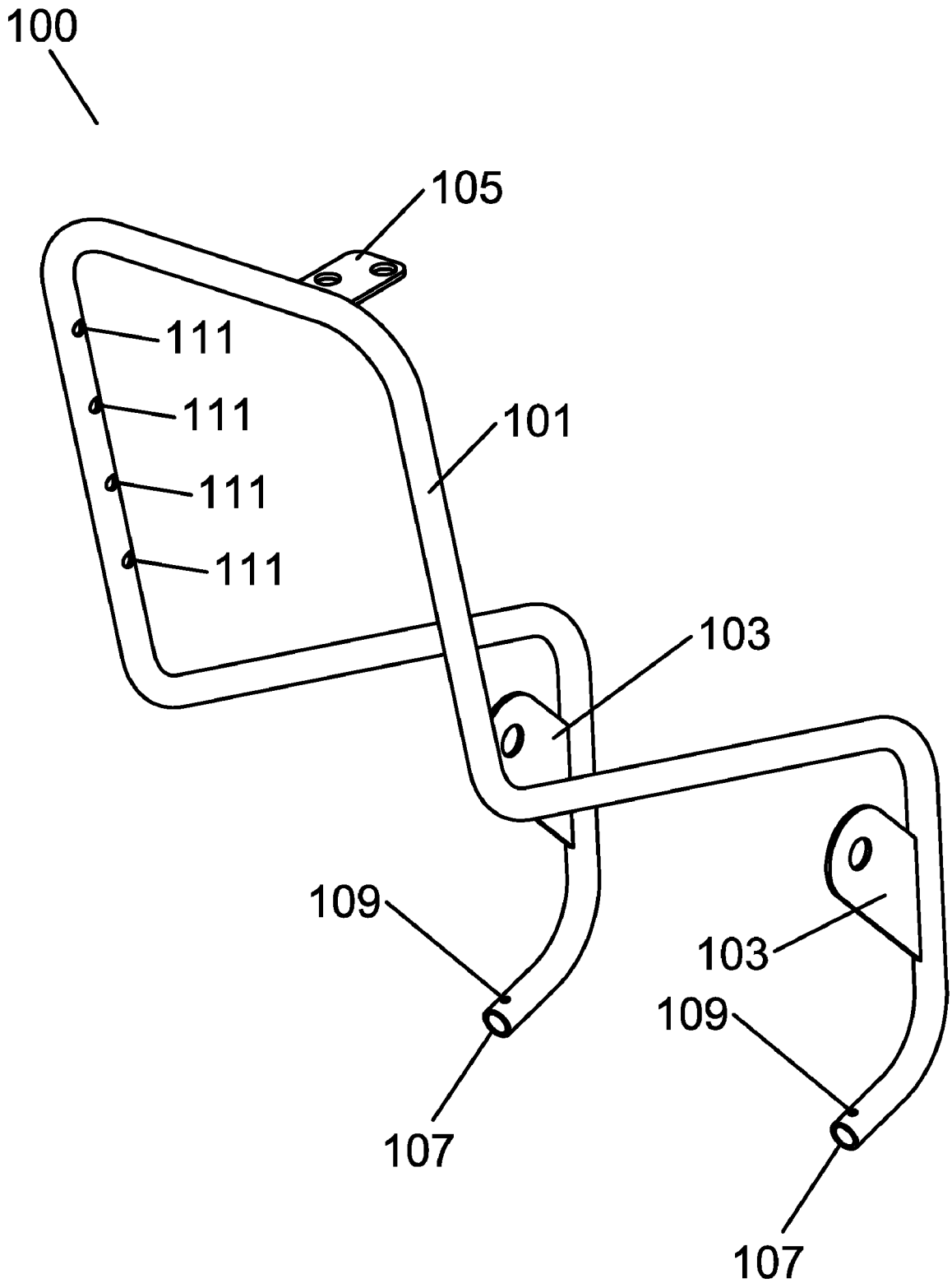
FIG. 1 is a perspective view of a no drill multiport drive shower according to one embodiment of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

FIG. 1 is a perspective view of a no drill multiport drive shower 100 according to one embodiment of the present invention. Not shown for clarity is an outdrive unit upon which the present invention, and the various embodiments described herein, may be mounted. Examples of outdrive units include, for example, the Alpha One® and the Bravo One® from Mercury Marine® of Fond du Lac, Wis., USA. The term outdrive is being used to describe that portion of a marine propulsion system that extends into the water to provide mechanical thrust necessary to propel a boat.

The purpose of the no drill multiport drive shower is to provide cooling water to the upper portion of the outdrive unit upon which it is mounted using ram force intake of water that occurs while the boat is in motion. Proper lubrication and cooling of any mechanized unit such as an outdrive is essential for promoting the longevity of that unit. Under some operating conditions, an outdrive may generate enough heat to cause both cosmetic and mechanical deterioration to the outside casing. If the heat becomes excessive, it can lead to the breakdown and eventual failure of the outdrive oil all of which contribute to component wear and eventual outdrive failure.

The no drill multiport drive shower 100 surrounds the outdrive (not shown), and is attached to the ram lift assembly shaft of the outdrive by way of the no drill bracket 103 and is further attached to an upper mounting bolt on the outdrive by way of the upper mounting bracket 105.

The no drill multiport drive shower 100 is made from a material such as, for example, stainless steel. Other materials suitable for marine use may also be used. The distribution tube assembly 101 is, in one embodiment of the present invention, made from a metal tubing of about one half inch in outside diameter, with a wall thickness of about one-thirty second of an inch. The distribution tube assembly 101 is bent in a way similar to that depicted in FIGS. 1-4 or alternatively, in a way similar to that shown in FIGS. 5-8. Bending is accomplished through known pipe and tube bending techniques and equipment. The purpose of the bends is to allow the no drill multiport drive shower to attach around the periphery of an outdrive, and the bends may vary depending on the particular model outdrive to which it is attached. In some embodiments of the present invention, flexible tubing suitable for marine use may be used. Variations on the bends made to the distribution tube assembly 101 will be known to those skilled in the art, and are based on the model outdrive to which it is attached. The distribution tube assembly 101 also contains a water delivery feature such as a plurality of dump ports 111 that direct the cooling water to the various parts of the outdrive. The dump ports may be any number of openings in the distribution tube. The dump ports may be made using a drill press, CNC machine, router, they may be molded, cast, or the like. The distribution tube assembly 101 also has a pickup port 107 or a pair of pickup ports 107. The pickup ports 107 may be, in one embodiment of the present invention, the open ends of the metal tube that is used to make the distribution tube assembly. In operation, the pickup ports 107 are below the surface of the water and face forward with respect to the boat having the outdrive, thus allowing water to enter the distribution tube assembly with ram force while the vessel is underway. In some embodiments of the present invention, the pickup ports have a debris filter to prevent debris such as twigs, rocks, and the like from entering the distribution tube assembly 101 and causing a clog or otherwise impeding water flow. In one embodiment of the present invention, the debris filter is a filtration pin 109. The filtration pin 109 may be, for example, a rolled stainless steel pin that is fit through two holes in the wall of the distribution tube assembly under tension such that the filtration pin 109 remains fixed in the opening of the pickup port 107, preventing debris from entering and subsequently clogging the distribution tube assembly 101.

The no drill multiport drive shower depicted in FIG. 1 also has at least one, and in many instances a pair of no drill brackets 103. The no drill bracket is made from a material suitable for a marine application, such as, for example, a stainless steel, and may have an angled surface to allow attachment to the distribution tube assembly 101, and to further provide support to the distribution tube assembly when attached to the outdrive. The angle also serves to lower the point of attachment of the no-drill bracket on the distribution tube assembly 101, closer to the waterline and the pickup port 107, thus providing a shorter moment arm with respect to the velocity vector of the water. The method of attachment may be, in one embodiment of the present invention, welding. In use, the no drill bracket is attached to the ram lift assembly shaft of the outdrive by way of a hole through which the ram lift assembly shaft is passed through and secured. Other attachment points may include assembly bolts for the lower unit of the outdrive or any other fastener or structure on the lower portion of the outdrive. The no drill multiport drive shower also has an upper mounting bracket 105 that is made from a material suitable for a marine application such as, for example, a stainless steel. The method of attachment may be, in one embodiment of the present invention, welding. If the no drill multiport drive shower is made from a stainless steel. MIG welding techniques may be employed, such as, for example, spray-arc, short-circuiting, or pulsed-arc transfer. TIG welding may also be employed, or any other fastening or joining technique known to those skilled in the art. The upper mounting bracket 105 is used to retain the upper portion of the no drill multiport drive shower 100 by way of a bolt attached to the outdrive.

In other embodiments of the present invention, the no drill bracket and the upper mounting bracket may be cast using plastic or metal fabrication techniques, or may be joined using other fastening techniques known to those skilled in the art.

Figure 2:
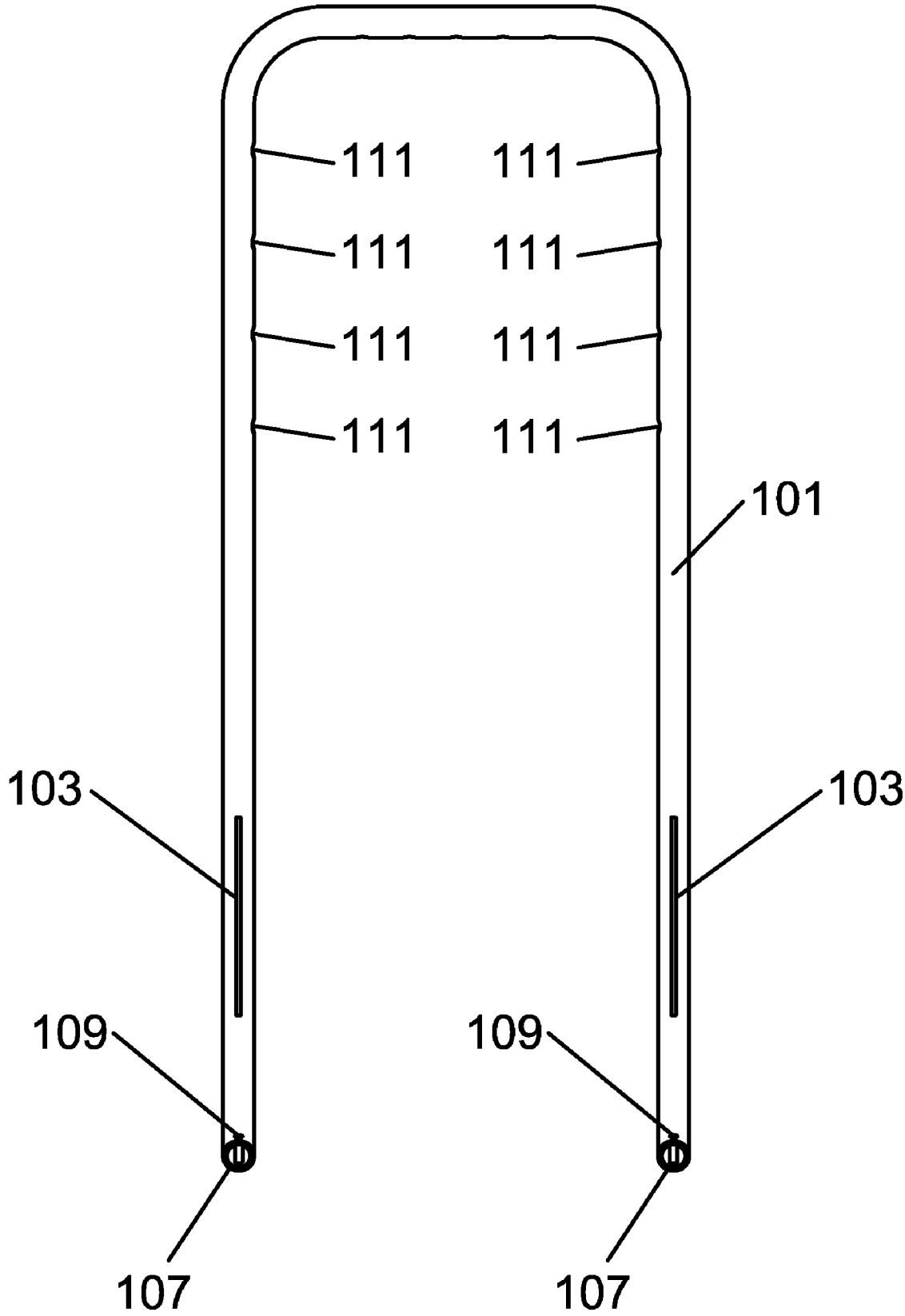
FIG. 2 is a frontal plan view of the no drill multiport drive shower depicted in FIG. 1.

FIG. 2 depicts a frontal plan view of the no drill multiport drive shower depicted in FIG. 1. The distribution tube assembly 101 is visible, as is the bottom view of the no drill bracket 103, the pickup ports 107, the filtration pins 109, and the dump ports 111. The upper mounting bracket 105 is not visible in FIG. 2.

Figure 3:
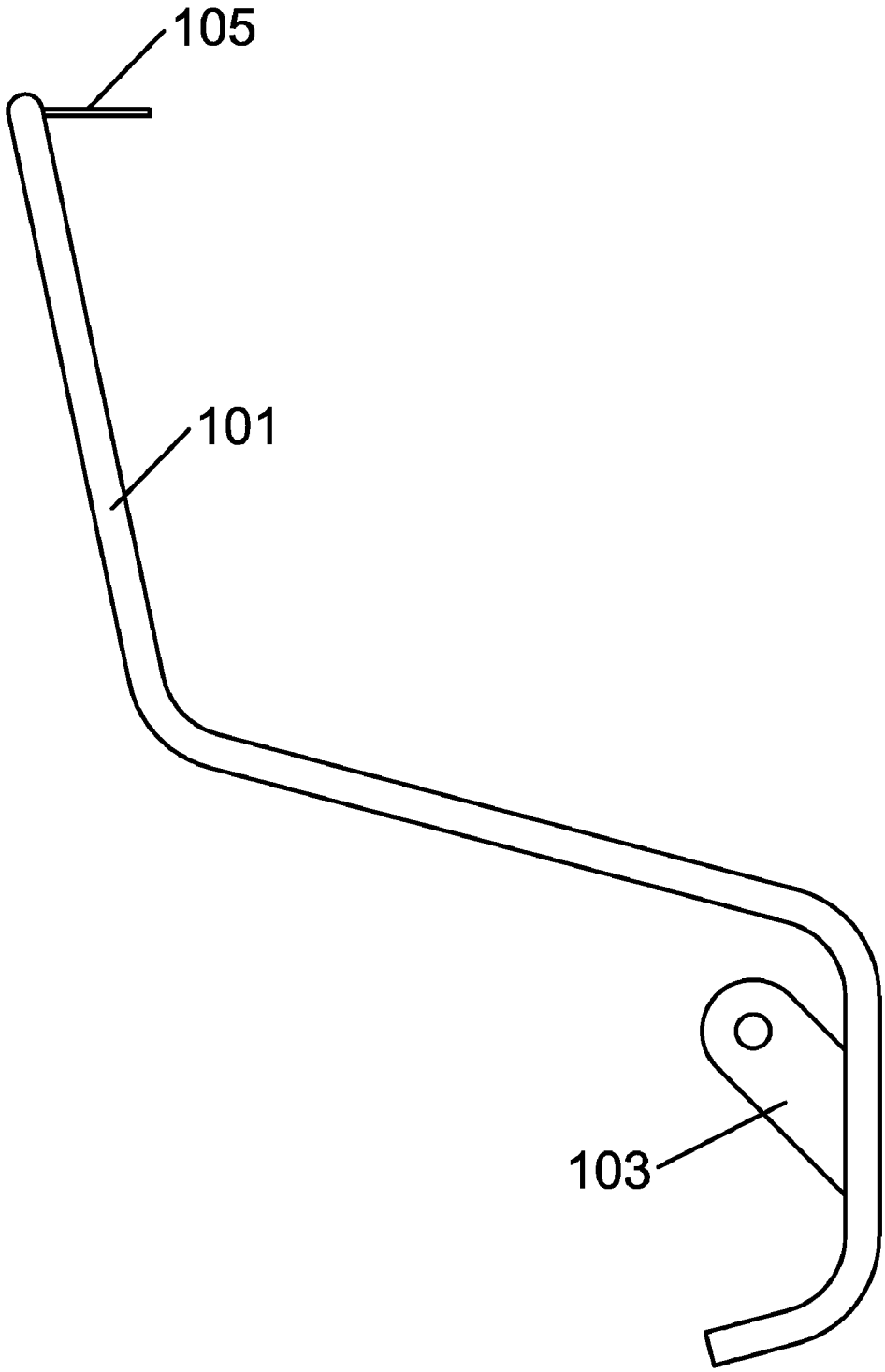
FIG. 3 is a side view of the no drill multiport drive shower depicted in FIG. 1.

FIG. 3 shows a side view of the no drill multiport drive shower depicted in FIG. 1. The distribution tube assembly 101 can be seen with both the no drill bracket 103 and the upper mounting bracket 105 visible.

Figure 4:
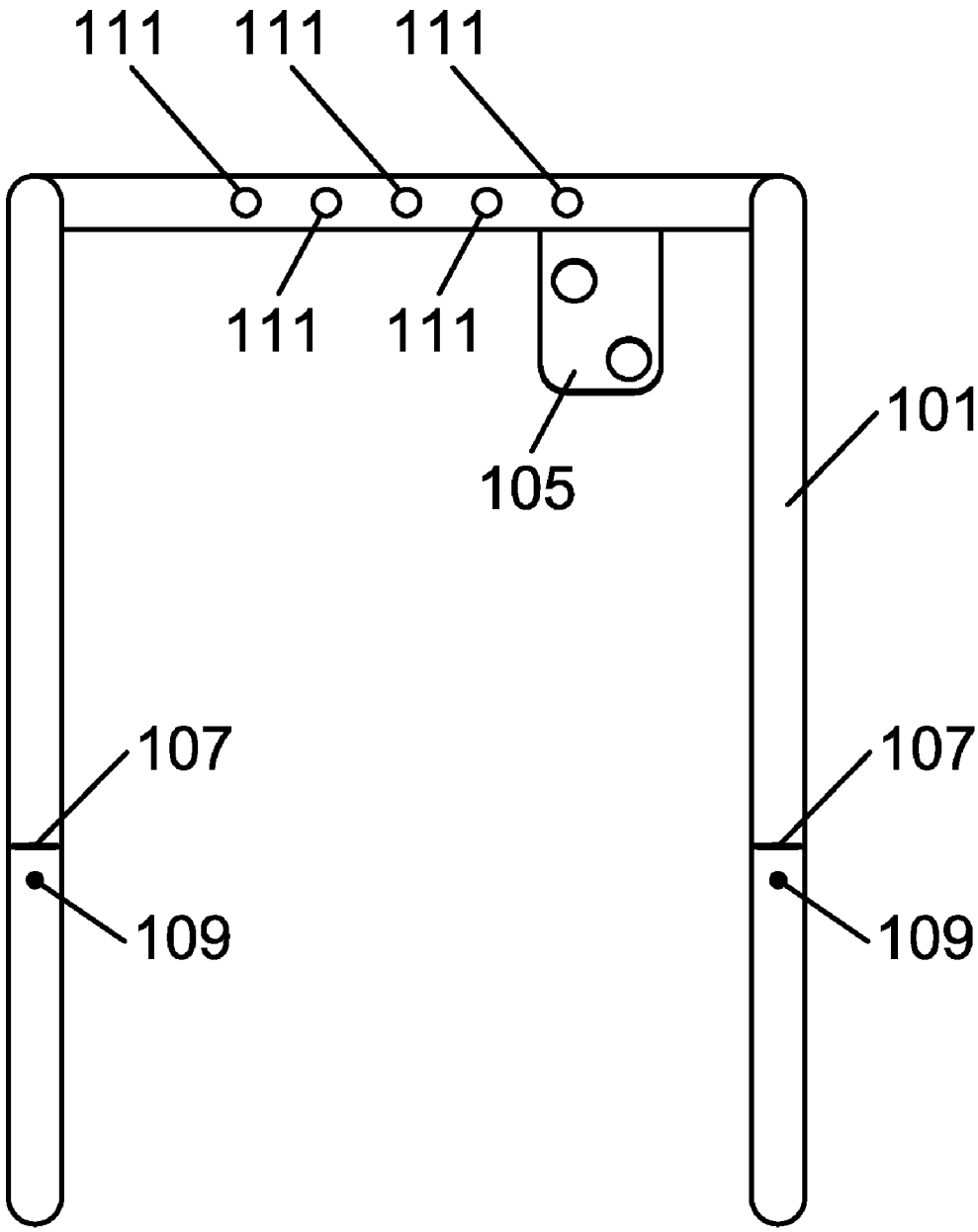
FIG. 4 is a bottom plan view of the no drill multiport drive shower depicted in FIG. 1.

FIG. 4 is a bottom plan view of the no drill multiport drive shower depicted in FIG. 1. The distribution tube assembly 101 can be seen along with the upper mounting bracket 105, the pickup ports 107, the filtration pins 109, and the dump ports 111. The no drill brackets 103 cannot be seen in FIG. 4.

Figure 5:
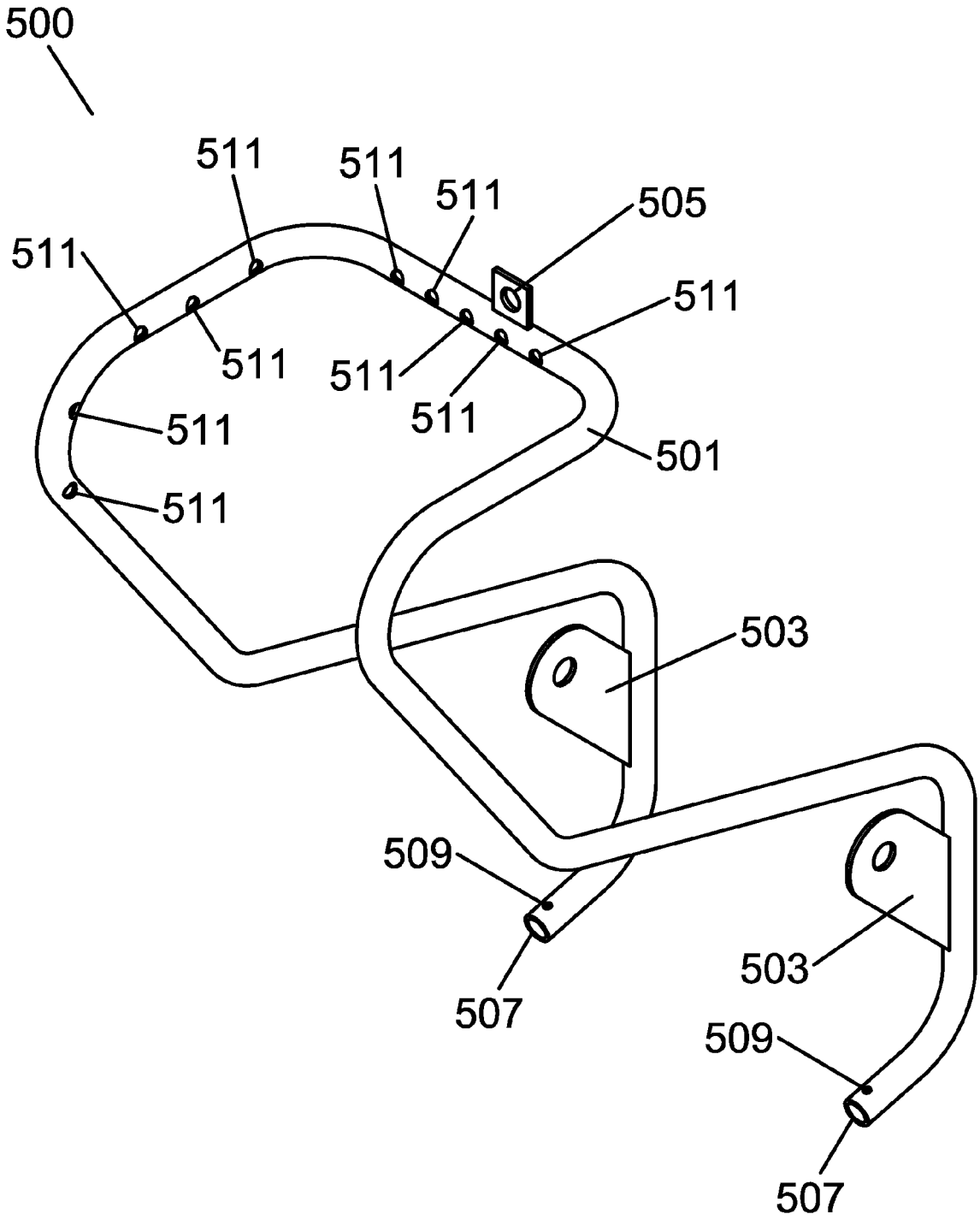
FIG. 5 is a perspective view of a no drill multiport drive shower according to a second embodiment of the present invention.

FIG. 5 is a perspective view of a no drill multiport drive shower according to a second embodiment of the present invention. As noted previously, the bends made in fabricating the distribution tube assembly may vary for either cosmetic purposes or depending on the outdrive assembly feature used to attach the multiport drive shower to a particular model outdrive. This second embodiment will be described in a similar manner to the description in FIG. 1. The no drill multiport drive shower 500 surrounds the outdrive (not shown), and is attached to the ram lift assembly shaft of the outdrive by way of the no drill bracket 503 and is further attached to an upper mounting bolt on the outdrive by way of the upper mounting bracket 505.

The no drill multiport drive shower 500 is made from a material such as, for example, stainless steel. Other materials suitable for marine use may also be used. The distribution tube assembly 501 is, in one embodiment of the present invention, made from a metal tubing of about one half inch in outside diameter, with a wall thickness of about one-thirty second of an inch. The distribution tube assembly 501 is bent in a way similar to that depicted in FIGS. 5-8 or alternatively, in a way similar to that shown in FIGS. 1-4. Bending is accomplished through known pipe and tube bending techniques and equipment. The purpose of the bends is to allow the no drill multiport drive shower to attach around the periphery of an outdrive, and the bends may vary for either cosmetic purposes or depending on the outdrive assembly feature used to attach the multiport drive shower to a particular model outdrive. Variations on the bends made to the distribution tube assembly 501 will be known to those skilled in the art based on the model outdrive. The distribution tube assembly 501 also contains a water delivery feature such as a plurality of dump ports 511 that direct cooling water to the various parts of the outdrive. The dump ports may be any number of openings in the distribution tube. The dump ports may be made using a drill press, CNC machine, router; they may be molded or cast, laser cut, stamped, or the like. The distribution tube assembly 501 also has a pickup port 507 or a pair of pickup ports 507. The pickup ports 507 may be, in one embodiment of the present invention, the open ends of the metal tube that is used to make the distribution tube assembly. In operation, the pickup ports 507 are below the surface of the water and face forward with respect to the vessel having the outdrive, thus allowing water to enter the distribution tube assembly with a ram force while the vessel is underway. In some embodiments of the present invention, the pickup ports have a debris filter to prevent debris such as twigs, rocks, and the like from entering the distribution tube assembly 501 and causing a clog or otherwise impeding water flow. In one embodiment of the present invention, the debris filter is a filtration pin 509. The filtration pin 509 may be, for example, a rolled stainless steel pin that is fit through two holes in the wall of the distribution tube assembly under tension such that the filtration pin 509 remains fixed in the opening of the pickup port 507, preventing debris from entering and subsequently clogging the distribution tube assembly 501.

The no drill multiport drive shower depicted in FIG. 5 also has at least one, and in many instances a pair of no drill brackets 503. The no drill bracket is made from a material suitable for a marine application, such as, for example, a stainless steel, and may have an angle to allow attachment to the distribution tube assembly 501, and to further provide support to the distribution tube assembly when attached to the outdrive. The angle also serves to lower the point of attachment of the no-drill bracket on the distribution tube assembly 101, closer to the waterline and the pickup port 107, thus providing a shorter moment arm with respect to the velocity vector of the water. The method of attachment may be, in one embodiment of the present invention, welding. If the no drill multiport drive shower is made from a stainless steel, MIG welding techniques may be employed, such as, for example, spray-arc, short-circuiting, or pulsed-arc transfer. TIG welding may also be employed, or any other fastening or joining technique known to those skilled in the art. In use, the no drill bracket is attached to the ram lift assembly shaft of the outdrive by way of a hole through which the ram lift assembly shaft is passed through and secured. Other attachment points may include assembly features for the upper and lower unit of the outdrive or any other fastener or features on the lower portion of the outdrive. The no drill multiport drive shower also has an upper mounting bracket 505 that is made from a material suitable for a marine application such as a stainless steel. The method of attachment may be, in one embodiment of the present invention, welding. If the no drill multiport drive shower is made from a stainless steel, MIG welding techniques may be employed, such as, for example, spray-arc, short-circuiting, or pulsed-arc transfer. TIG welding may also be employed, or any other fastening or joining technique known to those skilled in the art. The upper mounting bracket 505 is used to retain the upper portion of the no drill multiport drive shower 500 by way of a bolt attached to the outdrive.

In other embodiments of the present invention, the no drill bracket and the upper mounting bracket may be cast using plastic or metal fabrication techniques, or may be joined using other fastening techniques known to those skilled in the art.

Figure 6:
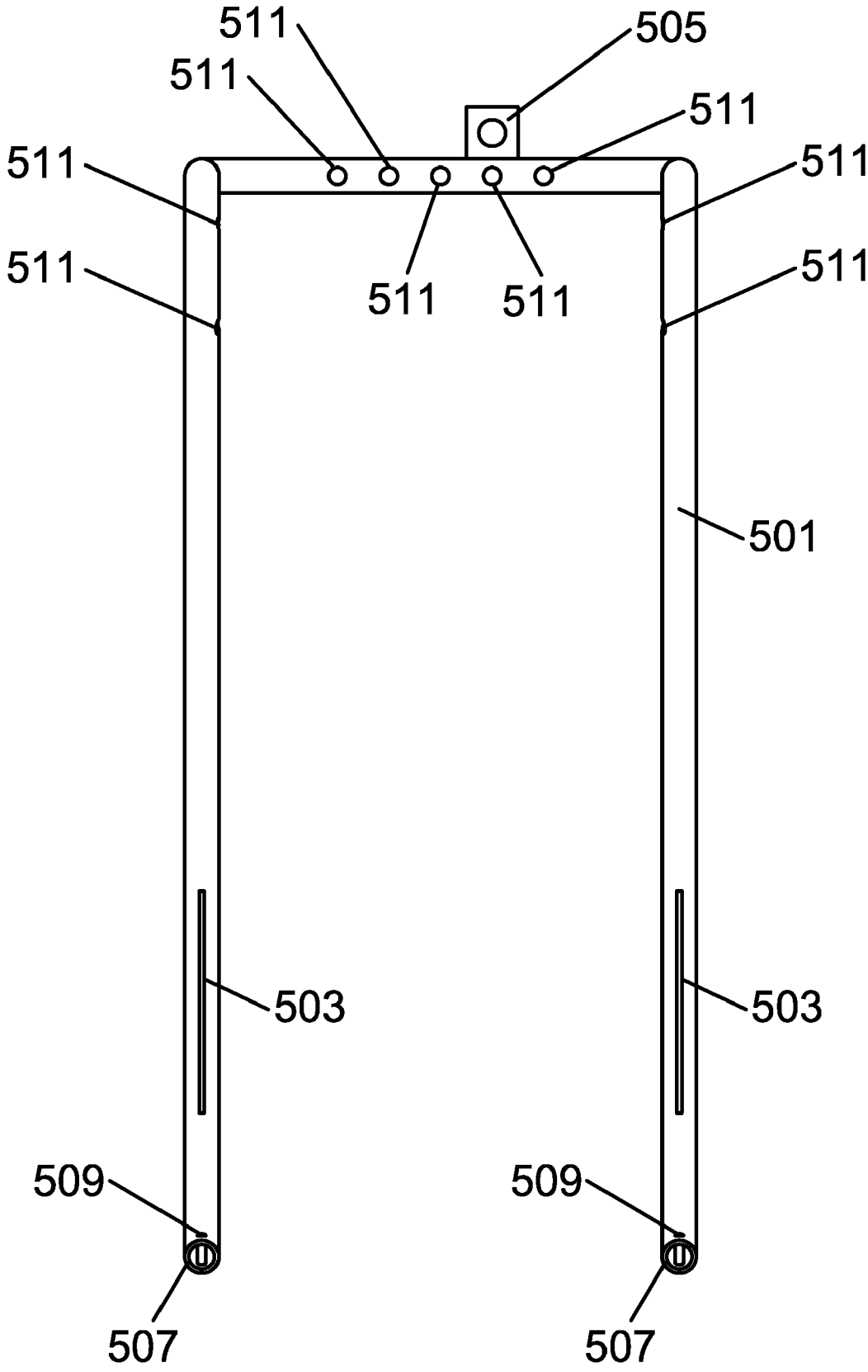
FIG. 6 is a frontal plan view of the no drill multiport drive shower depicted in FIG. 5.

FIG. 6 depicts a frontal plan view of the no drill multiport drive shower depicted in FIG. 5. The distribution tube assembly 501 is visible, as is the bottom view of the no drill bracket 503, the upper mounting bracket 505, the pickup ports 507, the filtration pins 509, and the dump ports 511.

Figure 7:
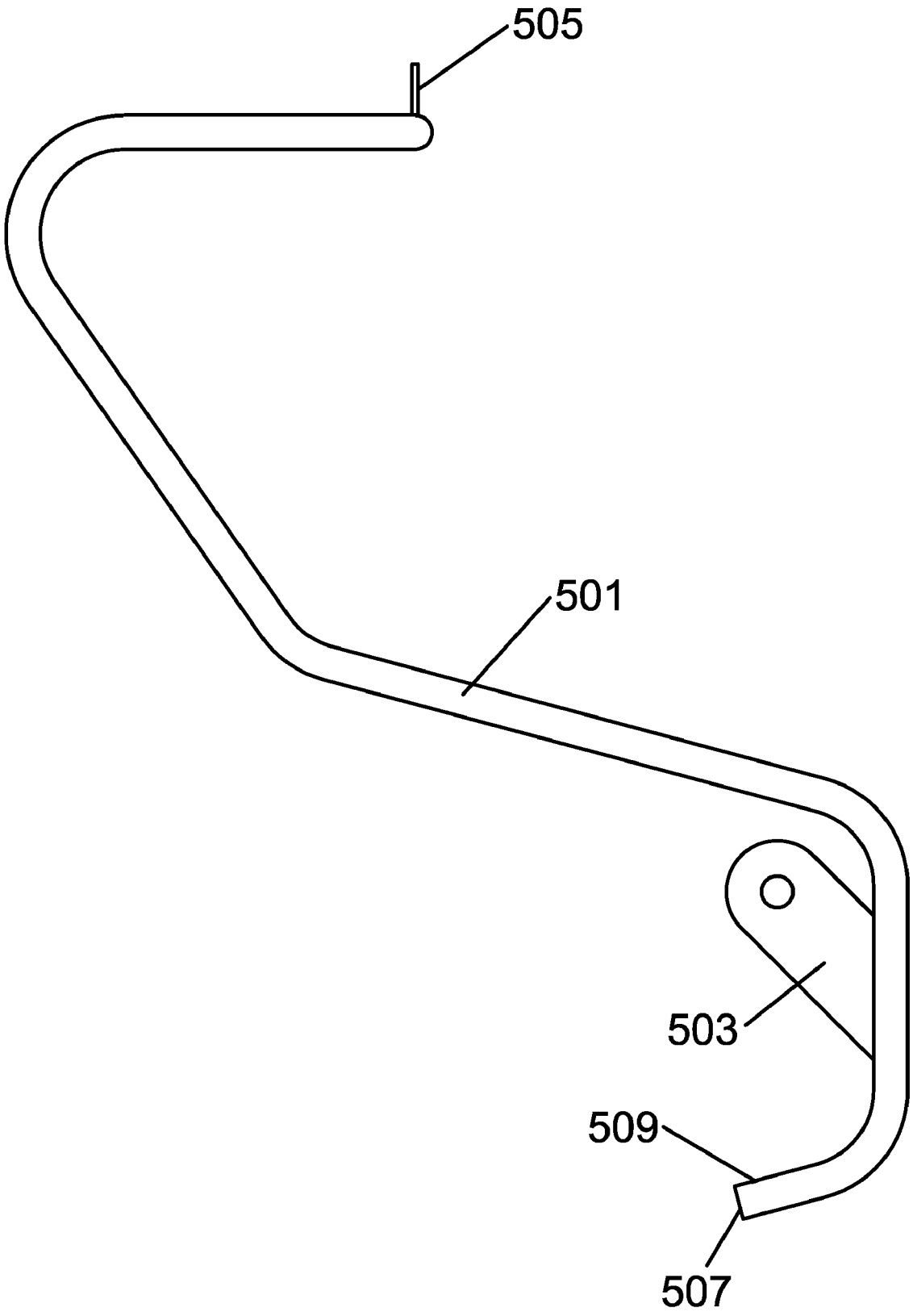
FIG. 7 is a side view of the no drill multiport drive shower depicted in FIG. 5.

FIG. 7 shows a side view of the no drill multiport drive shower depicted in FIG. 5. The distribution tube assembly 501 can be seen with both the no drill bracket 503 and the upper mounting bracket 505 visible. In addition, the pickup port 507 can be seen with a filtration pin 509.

Figure 8:
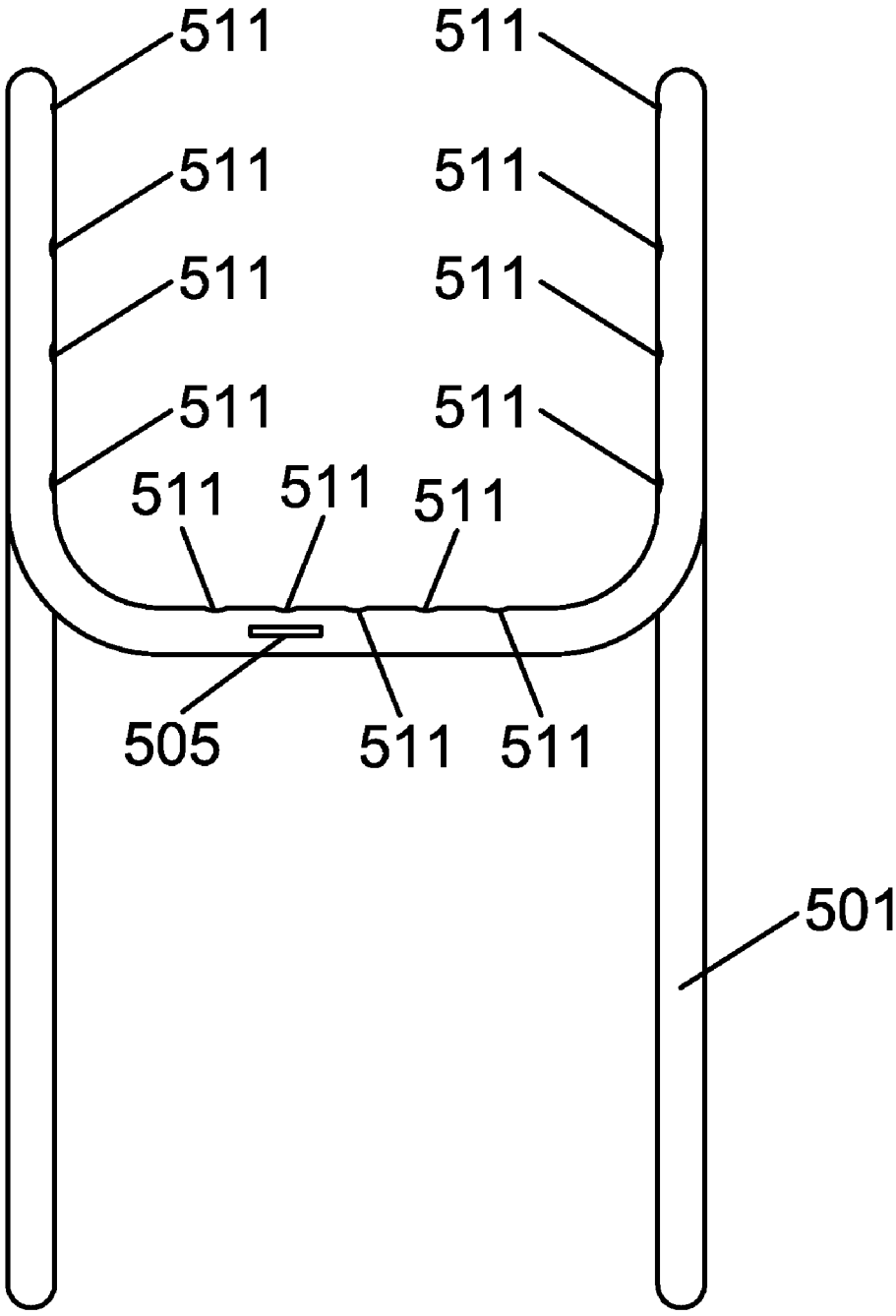
FIG. 8 is a top plan view of the no drill multiport drive shower depicted in FIG. 5.

Lastly, FIG. 8 is a top plan view of the no drill multiport drive shower depicted in FIG. 5. The distribution tube assembly 501 can be seen along with the upper mounting bracket 505, the pickup ports 107, the filtration pins 109, and the dump ports 111. The no drill brackets 103 cannot be seen in FIG. 4.

It is, therefore, apparent that there has been provided, in accordance with the various objects of the present invention, a no drill multiport drive shower. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A cooling apparatus for a marine propulsion system outdrive unit having a lift ram assembly shaft, the cooling apparatus comprising:

a distribution tube assembly having at least one pickup port and a water delivery feature, the pickup port being an end of the distribution tube assembly that is open along a vertical tube axis to receive cooling water into the distribution tube assembly when mounted on a marine propulsion system outdrive unit and the water delivery feature positioned to face the drive unit for delivering cooling water from the distribution tube assembly to the outdrive unit;

at least one no drill bracket mechanically attached to said distribution tube assembly for mounting the cooling apparatus to the lift ram assembly shaft of said outdrive unit; and an upper mounting bracket mechanically attached to said distribution tube assembly for mounting the cooling apparatus to said outdrive unit.

2. The cooling apparatus as recited in claim 1, wherein the water delivery feature contains dump ports.

3. The cooling apparatus as recited in claim 1 further comprising a debris filter connected to said pickup port.

4. The cooling apparatus as recited in claim 3, wherein the debris filter is a pin inserted through the pickup port.

5. The cooling apparatus as recited in claim 3, wherein the debris filter is a narrowed opening in the pickup port.

6. The cooling apparatus as recited in claim 1, wherein the cooling apparatus is comprised of stainless steel.

7. The cooling apparatus as recited in claim 1, wherein the cooling apparatus is comprised of a plastic.

8. The cooling apparatus as recited in claim 1, wherein the cooling apparatus is comprised of flexible tubing.

9. A cooling apparatus for a marine propulsion system outdrive unit, the cooling apparatus comprising:

a distribution tube assembly having a symmetrical appearance and having a pair of pickup ports and a water delivery feature, each pickup port being an end of the distribution tube assembly that is open along a vertical tube axis to receive cooling water into the distribution tube assembly when mounted on a marine propulsion system outdrive unit, and the water delivery feature being positioned to face the drive unit for delivering cooling water from the distribution tube assembly to the outdrive unit; and a bracket assembly mechanically attached to said distribution tube assembly for mounting the cooling apparatus to said outdrive unit.

10. The cooling apparatus as recited in claim 9, wherein the water delivery feature contains dump ports.

11. The cooling apparatus as recited in claim 9 further comprising a debris filter connected to said pickup port.

12. The cooling apparatus as recited in claim 11, wherein the debris filter is a pin inserted through the pickup port.

13. The cooling apparatus as recited in claim 11, wherein the debris filter is a narrowed opening in the pickup port.

14. The cooling apparatus as recited in claim 9, wherein the cooling apparatus is comprised of stainless steel.

15. The cooling apparatus as recited in claim 9, wherein the cooling apparatus is comprised of a plastic.

16. The cooling apparatus as recited in claim 9, wherein the cooling apparatus is comprised of flexible tubing.

17. A no drill bracket for mounting to a cooling apparatus for a marine propulsion outdrive unit having a lift ram assembly shaft, the no drill bracket comprising:

a piece having two ends, at least one end having a generally vertically angled surface to allow attachment to the cooling apparatus;

a hole in the piece to receive the lift ram assembly shaft; and a means for rigid mechanical attachment of the piece to the cooling apparatus.

18. The no drill bracket as recited in claim 17, wherein the no drill bracket is made from stainless steel.

19. The no drill bracket as recited in claim 17, wherein the no drill bracket is made from a plastic.

* * * * *